US008403145B1

(12) United States Patent
Yip et al.

(10) Patent No.: US 8,403,145 B1
(45) Date of Patent: Mar. 26, 2013

(54) BOW MAKING DEVICE AND METHODS OF USE THEREOF

(75) Inventors: Yi-Ling Yip, Kearny, NJ (US); Patricia A. Corcoran, Pompton Lakes, NJ (US)

(73) Assignee: Berwick Offray LLC, Berwick, PA (US)

( * ) Notice: Subject to any disclaimer, the term of this patent is extended or adjusted under 35 U.S.C. 154(b) by 691 days.

(21) Appl. No.: 12/509,931

(22) Filed: Jul. 27, 2009

(51) Int. Cl.
*B65D 69/00* (2006.01)

(52) U.S. Cl. ..... 206/575; 206/391; 206/394; 206/409; 223/46

(58) Field of Classification Search ..... 206/391, 206/392, 394, 395, 397, 575, 409; 220/212, 220/735; 223/1, 44, 46; 428/4, 5
See application file for complete search history.

(56) References Cited

U.S. PATENT DOCUMENTS

| | | | | |
|---|---|---|---|---|
| 696,361 | A | 3/1902 | Chase | |
| 1,010,155 | A | 11/1911 | Lange | |
| 1,307,069 | A | 6/1919 | Weismantel | |
| 1,598,310 | A | 8/1926 | Quinlan | |
| 2,077,370 | A | 4/1937 | Reynolds | |
| 2,105,436 | A | 1/1938 | Flatto | |
| 2,107,194 | A * | 2/1938 | Yacker et al. | 206/214 |
| 2,521,863 | A | 9/1950 | Mertz | |
| 2,542,222 | A * | 2/1951 | Welch | 223/46 |
| 2,569,943 | A | 10/1951 | Mitchell | |
| 2,666,249 | A | 1/1954 | Ruiz et al. | |
| 2,763,080 | A | 9/1956 | Welch | |
| 2,905,368 | A | 9/1959 | Runyan | |
| 3,126,093 | A * | 3/1964 | Bradley et al. | 206/752 |
| 3,223,440 | A | 12/1965 | Rosenzweig | |
| 3,236,426 | A | 2/1966 | Kerrigan et al. | |
| 3,289,900 | A | 12/1966 | Mashburn, Jr. et al. | |
| 3,377,674 | A | 4/1968 | Brassaw et al. | |
| 3,428,227 | A | 2/1969 | Cavoli | |
| 3,462,049 | A | 8/1969 | Smith | |
| 3,501,070 | A | 3/1970 | Shattuck | |
| 3,816,888 | A | 6/1974 | Rather, Jr. | |
| 3,850,293 | A * | 11/1974 | Scaringi | 206/575 |
| 3,854,179 | A | 12/1974 | Montoya | |
| 4,186,833 | A * | 2/1980 | Homan | 206/391 |
| 4,337,578 | A | 7/1982 | Seals | |
| 4,410,113 | A | 10/1983 | Palombo | |
| 4,454,968 | A | 6/1984 | StLawrence | |

(Continued)

OTHER PUBLICATIONS

U.S. Appl. No. 08/133,618, title: Bow Making Apparatus, filed Oct. 7, 1993 (abandoned) (21 pages).

(Continued)

*Primary Examiner* — Luan K Bui
(74) *Attorney, Agent, or Firm* — McCarter & English, LLP

(57) ABSTRACT

Disclosed herein is a bow making device and methods of use thereof. The device is configured to include one or more ribbon rolls, an elongated flexible member, a container, and a lid having a clip and indicia for ribbon measurement. In some aspects, the clip includes a base and a plurality of fingers defining a channel and a receptacle. The container includes transparent material such that the rolls are visually-perceptible through the transparent material, and slits are provided for dispensing ribbon. In use, ribbon is dispensed through the slits and then formed into a bow. Regarding the latter, the elongated flexible member is slid through the channel into receptacle, and the ribbon is folded into measured lengths and slid through the channel into the receptacle. A user pulls the elongated flexible member and measured lengths of ribbon out of the clip through the channel and ties the ribbon to form a bow.

7 Claims, 6 Drawing Sheets

U.S. PATENT DOCUMENTS

| | | | | |
|---|---|---|---|---|
| 4,629,100 | A | 12/1986 | Owens | |
| 4,714,182 | A | 12/1987 | Hecht | |
| 5,100,706 | A | 3/1992 | Zaweski | |
| 5,215,791 | A | 6/1993 | Davignon | |
| 5,411,188 | A | 5/1995 | Teuten | |
| 5,617,979 | A | 4/1997 | Cavender | |
| 5,662,250 | A * | 9/1997 | Werling | 223/46 |
| 5,810,214 | A | 9/1998 | Hecht | |
| 5,913,450 | A * | 6/1999 | Runkel | 220/696 |
| 5,975,383 | A | 11/1999 | Cavender et al. | |
| 6,000,586 | A | 12/1999 | Cavender | |
| 6,131,778 | A | 10/2000 | Etzion | |
| 2008/0073386 | A1 * | 3/2008 | Lavorato | 223/46 |

OTHER PUBLICATIONS

Bowdabra (from Archive.org), available at http://web.archive.org/web/20080612035745/http://www.bowdabra.com/ (at least as early as Jun. 12, 2008 per Archive.org) (2 pages).

TheCardLadies Adjustable Bow Maker (from Archive.org), available at http://web.archive.org/web/20080420121139/http://www.thecardladies.com/BowMaker.htm (at least as early as Apr. 20, 2008 per Archive.org) (3 pages).

Jiffy Bow Maker, available at www.jiffbowmaker.com (prior to Jul. 27, 2009) (additional info at Archive.org) (3 pages).

Fiskars Bow Maker, available at http://www.fiskarscrafts.com/tools/t_bow-maker.aspx and available at http://crafts-sewing.hsn.com/fiskars-bow-maker-ultimate-bow-and-floral-stapler_p-3331722_xp.aspx (Prior to Jul. 27, 2009) (4 pages).

Itsy Bitsy Bow Maker (from Archive.org), available at http://web.archive.org/web/20071026124534/http://www.packrat-pro.com/bows/bows.htm and http://web.archive.org/web/20071026165758/http://www.packrat-pro.com/bows/bowhow1.htm (Oct. 26, 2007 per Archive.org) (6 pages).

* cited by examiner

BOW MAKING DEVICE AND METHODS OF USE THEREOF

FIELD OF THE INVENTION

The present invention relates to a device for enabling a user to create a bow from a ribbon. More specifically, the present invention relates to a device for facilitating folding by a user of ribbon and a kit for containing the device and dispensing the ribbon.

BACKGROUND OF THE INVENTION

It is known in the at to provide a tool for helping crafts enthusiasts and other users form a bow from a ribbon. However, a problem that often results in forming of a bow is crimping of the ribbon during the folding process. Ribbon that is crimped or has unnecessary creases can lease to formation of a bow having aesthetic qualities that are undesirable and not appealing. What is needed in the art is a bow making device that inhibits crimping of ribbon during the bow formation.

SUMMARY OF THE INVENTION

Preferred embodiments of the invention include a bow making device comprising a clip that has a channel and a receptacle that forms a space through which a ribbon can be pulled. In some aspects of the invention, the clip is secured to a surface having a plurality of ends, such that the clip is spaced apart from at least two of the ends, and indicia can be disposed on the surface to facilitate measurement of ribbon segments. In some aspects of the invention, the clip can include a base proximal the surface and a plurality of finders extending from the base away from the surface, such that the base and the fingers cooperate to, at least in part, define the space through which the ribbon is pulled. The clip is preferably formed monolithically and of a resiliently flexible material.

In some embodiments of the invention, the bow making device includes a lid that comprises the surface to which the clip is secured and can include a container with an interior for receiving the clip while the clip is secured to the surface. In some aspects, one or more ribbon rolls are receivable within the interior and dispensable through slits formed in the container. The container can include transparent portions through which the ribbon roll(s) in the container are visually-perceptible by a user of the bow making device. A wire or other flexible elongated member can be provided in combination with the lid and the container for use in forming a bow from ribbon segments.

In some embodiments of the invention, a method is provided for dispensing and/or measuring ribbon segments for formation of a bow. The wire is positioned to extend through the receptacle, and, thereabove, a ribbon segment is pulled into the receptacle substantially free of crimping and creasing, such that the thickness of the ribbon extends in a direction opposing the surface to which the clip is attached. Lengths of ribbon are measured into a figure eight with the aid of indicia disposed on the surface, and the wire is pulled up and tied to form a bow.

Additional features, functions and benefits of the disclosed bow making device will be apparent from the detailed description which follows, particularly when read in conjunction with the accompanying figures.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE INVENTION

Figure 1:
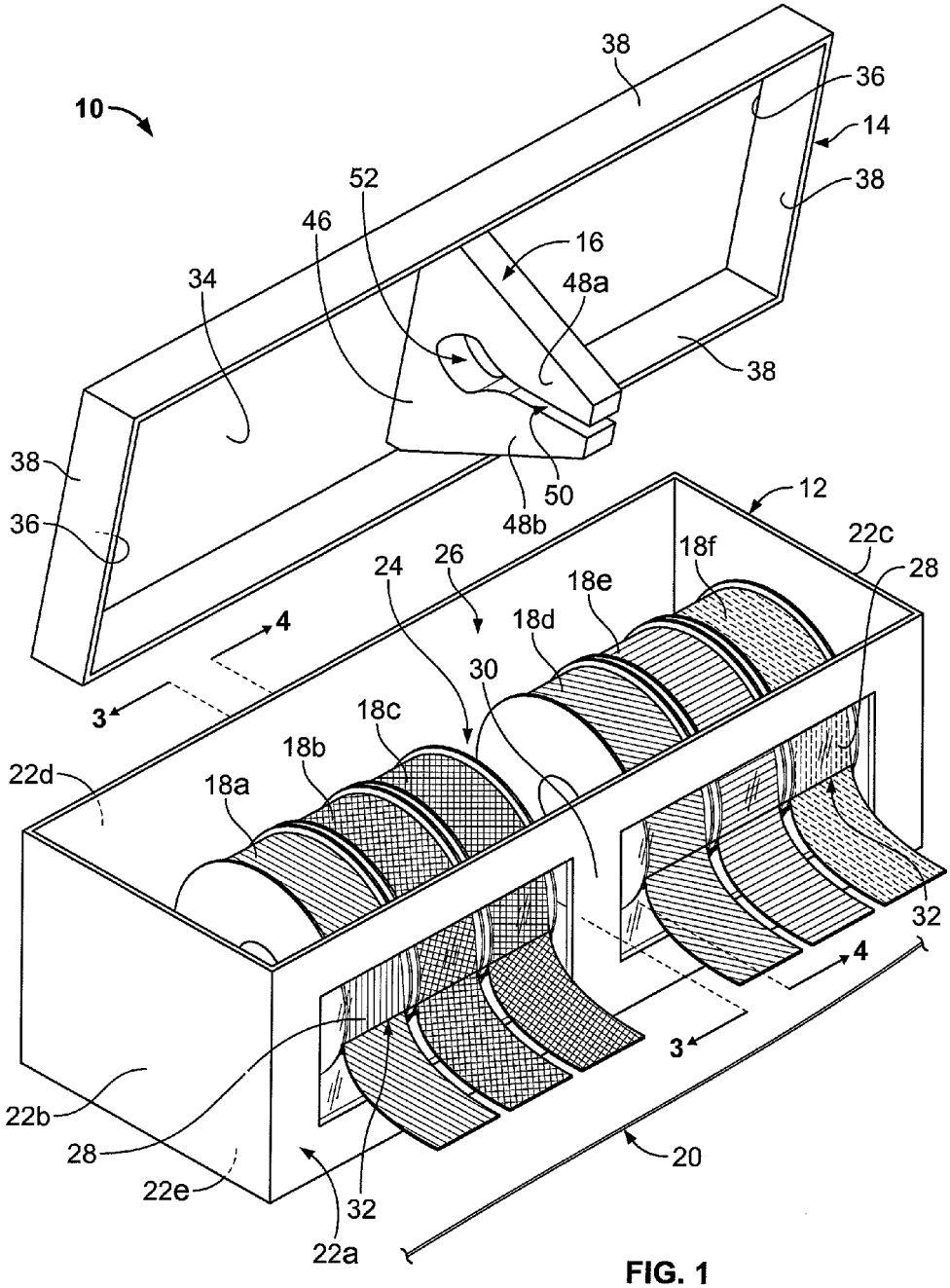
FIG. 1 is a perspective view showing a bow making device constructed in accordance with an exemplary embodiment of the present invention, the bow making device being shown to include a container, a plurality of ribbon rolls, a wire, and a lid provided with a clip.

Referring to FIGS. 1-4, an exemplary bow making device 10 is shown constructed in accordance with an exemplary embodiment of the present invention. The bow making device 10 is shown to include a container 12 and a lid 14 provided with a clip 16, as well as a plurality of ribbon rolls 18*a-f* and an elongated flexible member, e.g., a wire 20, each of which shall be discuss with detail below.

The container 12 is preferably formed of a cardboard-like material and preferably has a rectangular, box-like shape, though other materials and shapes are contemplated. The container 12 has a plurality of container walls 22*a-e* defining an interior 24 and an opening 26, such as the open side shown in FIG. 1 (and/or another opening, such as a partially open side, for example). The container 12 is provided with one or more transparent portions 28, which can be formed of a clear plastic and provided with one or more of the container walls 22*a-e*. For example, the container wall 22*a* is shown to be provided with two transparent portions 28 that are each displaced from a center of the container wall 22*a*, such that the container wall 22*a* includes a center portion 30 flanked on a plurality of sides by the transparent portions 28. Openings, which are shown as slits 32, are provided with, and preferably defined by, the transparent portions 28. As discussed further below, ribbon can be dispensed through the slits 32 from ribbon rolls 18*a-f* stored in the interior 24 of the container 12.

Figure 2:
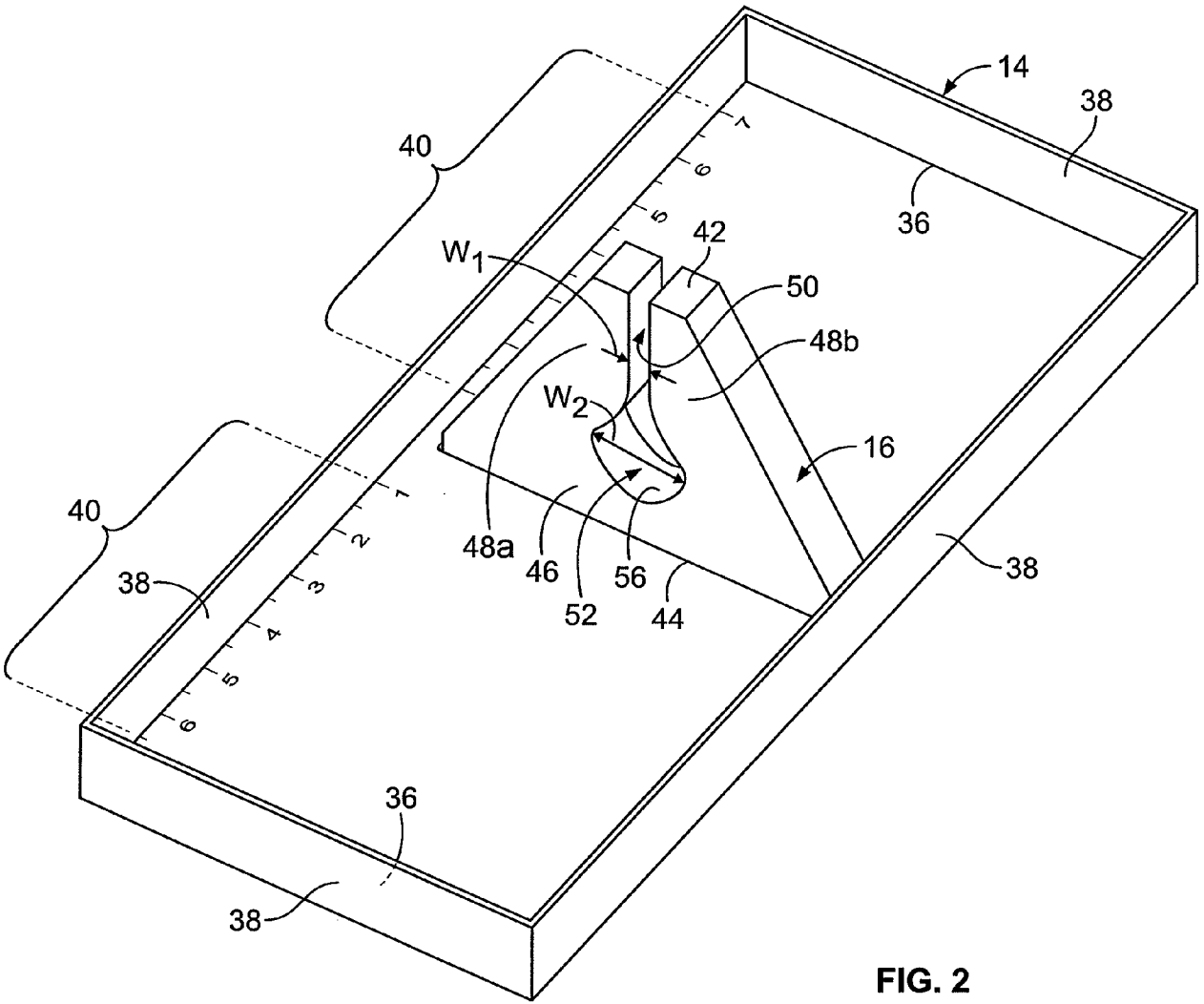
FIG. 2 is a perspective view showing the lid and clip of FIG. 1.
Figure 3:
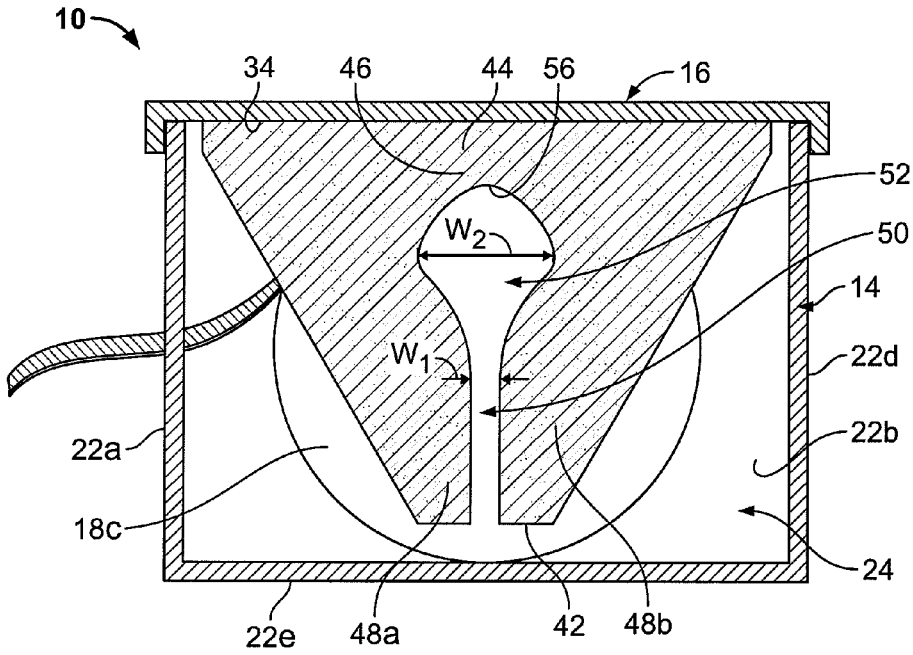
FIG. 3 is a sectional view of the container, lid, clip, and rolls taken along section line 3-3 of FIG. 1.
Figure 4:
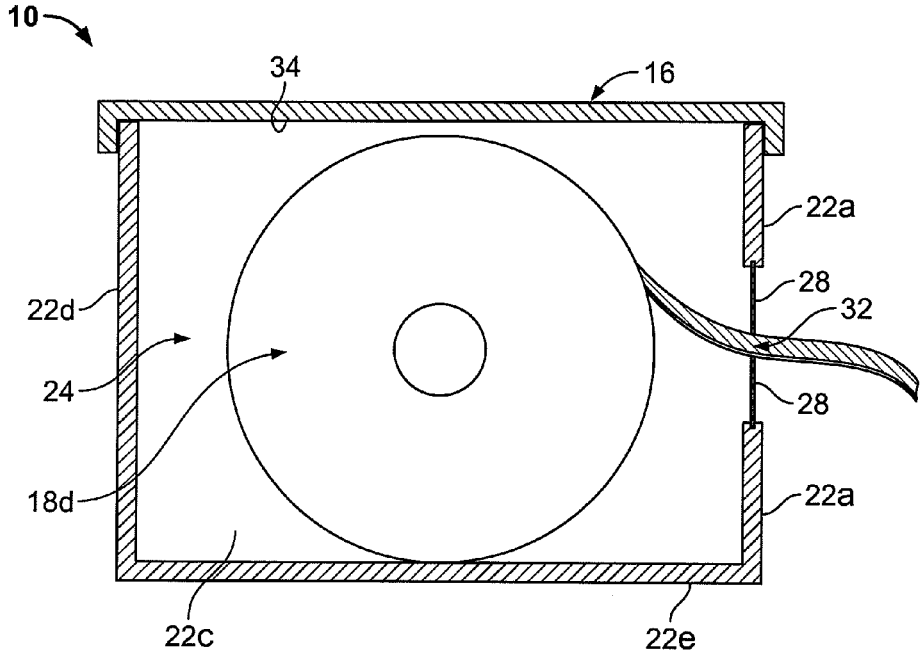
FIG. 4 is a sectional view of the container, lid, and rolls taken along section line 4-4 of FIG. 1.

Referring to FIGS. 1-4, the lid 14 is configured to mate with the container 12 and substantially enclose the opening 26 and interior 24 of the container 12. The lid 14, which is preferably formed of cardboard, is provided with a surface 34, which faces toward the interior 24 of the container 12 and opposes the container wall 22*e* when the lid 14 mates with the container 12. The surface 34 of the lid 14 includes a plurality of ends 36, and lid walls 38 extend from the ends 36 and other ends of the surface 34. As shown in FIG. 2, indicia 40 is disposed on the surface 34 in the form of a ruler designating a length as measured relative to a generally central location along the surface 34, for example. As will be discussed with further detail below, the indicia 40 can be used to measure folded ribbon into segments of length L during bow formation.

A clip 16 is secured at a generally central location along the surface 34 and spaced apart from at least two of the plurality of ends 36, such as those ends 36 being faced by the clip opening as shown in FIG. 2. The clip 16 includes an end through which an opening is provided, which is referenced herein as a first clip end 42, and further includes an end secured proximal the surface 34, which is referenced herein as a second clip end 44. The clip 16 preferably includes a base 46 at the second clip end 44 and a plurality of fingers 48*a-b* extending from the base 46. The open space of the clip 16 can be formed as a channel 50 and a receptacle 52 adjacent thereto, which can be defined by the fingers 48*a-b* and base 46, though it is contemplated that alternative or additional open space can be included.

The receptacle 52 is sized, dimensioned, and configured to seat a ribbon in a manner facilitative of reduced crimping and reduced creasing of the ribbon. For example, the ribbon is typically brought to be seated on a curved surface 54 of the receptacle 52 (and spaced apart from the surface 34), such that the thickness dimension (the smallest dimension) of the ribbon extends from the receptacle 52 inwardly and in an upward direction away from the surface 34. It is preferable for the receptacle 52 to have a teardrop shape, so as to function as a bottleneck inhibiting the inadvertent lifting of the ribbon up and out into the channel 50. Also, the receptacle 52 can include a plurality of widths that vary along an elevation of the clip 16, and the plurality of widths of the receptacle 52 preferably include a first width W1 greater than a width of the channel 50, which is referenced herein as width W2. A user can deftly pull the ribbon upward through the channel 50 when intentional, though the shape of the receptacle 52 inhibits unintentional lifting of the ribbons from the receptacle 52 to the channel 50. The receptacle 52 can be provided with a curved lower surface 56 that opens to face the channel 50. The curved surface 54 further inhibits crimping and creasing of the ribbon.

The bow making device 10 can be in an open position, such as that shown in FIG. 1, for example, and a closed position, such as that shown in FIGS. 3-5A, for example. When in a closed portion, the clip 16 is preferably received through the opening 26, into the interior 24, and in alignment with the center portion 30 of the container wall 22*a*, so as to be concealable by a center portion 30 having an opaque quality. At the same time, a plurality of ribbon rolls 18*a* are receivable for containment within the interior 24 of the container 12 in alignment with the transparent portions 28 and slits 32 thereof. The container 12 also receives the wire or other elongated flexible member 20, which is used to facilitate bow making when the bow making device 10 is in the open position.

Figure 5A:
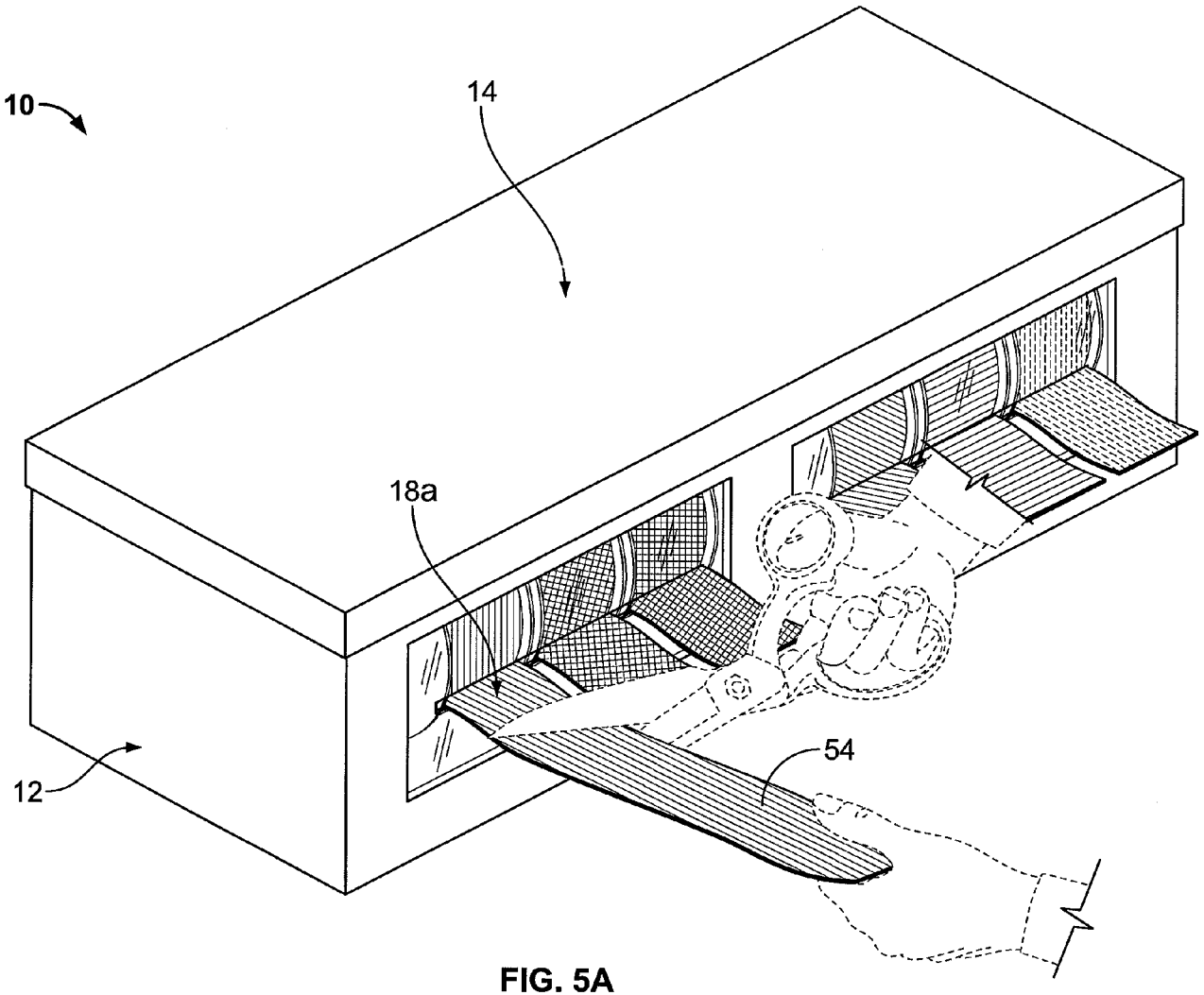
FIGS. 5A-5E are schematic figures showing an exemplary method of using the bow making device of FIG. 1.
Figure 5B:
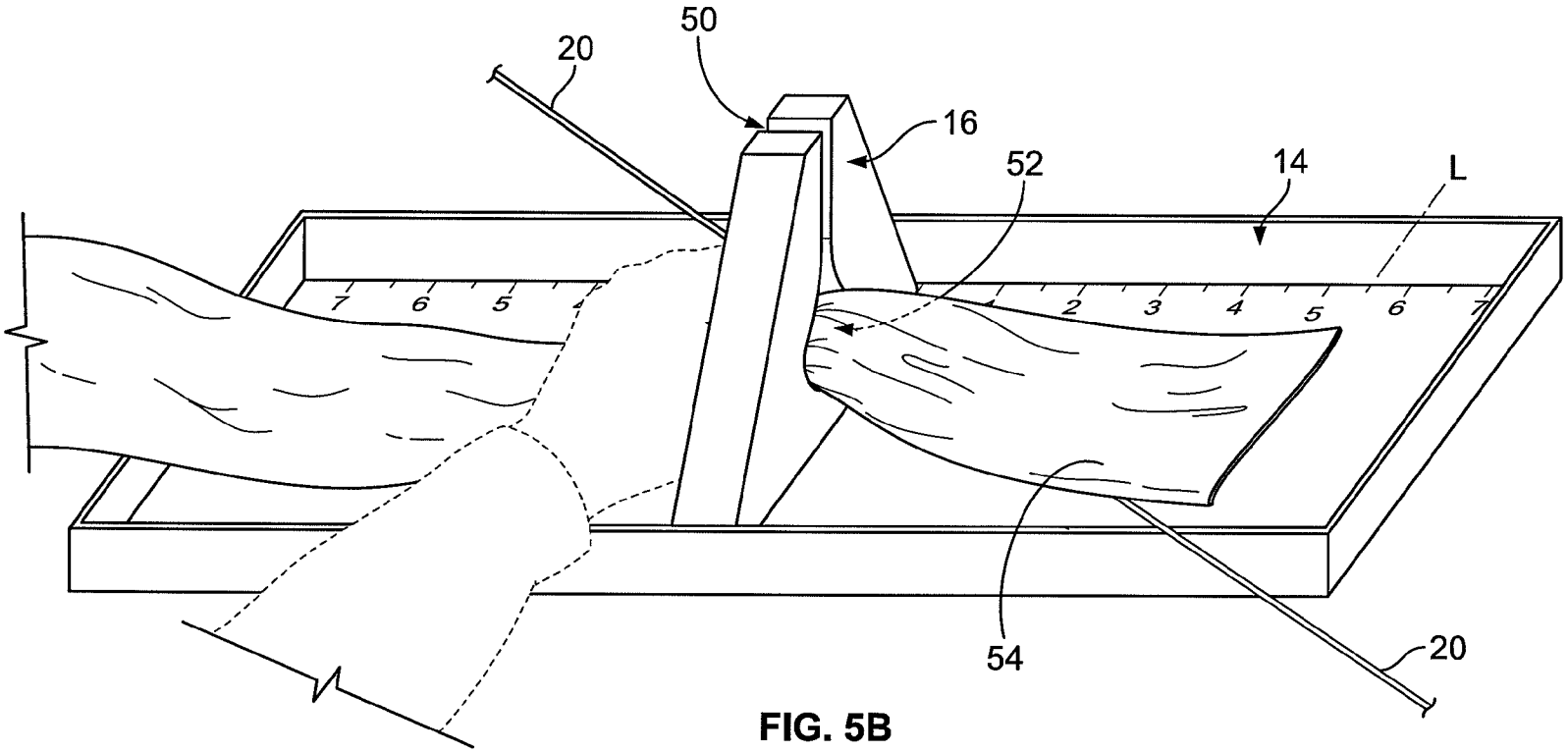
Figure 5C:
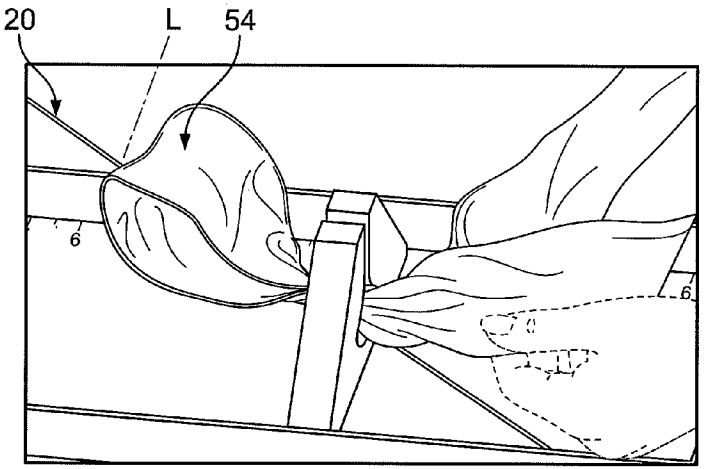
Figure 5D:
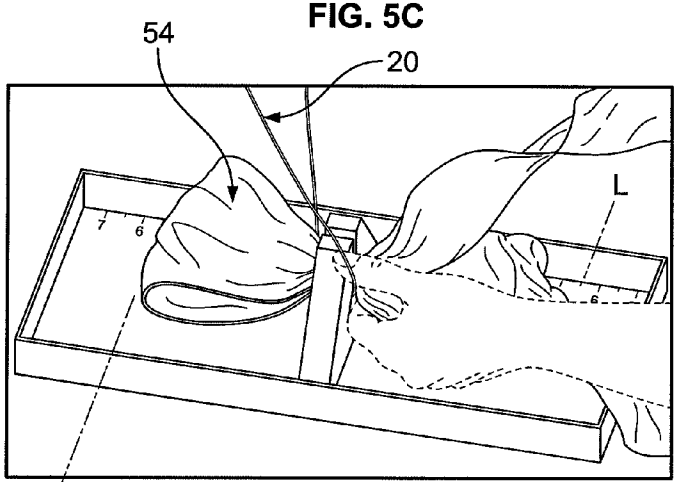
Figure 5E:
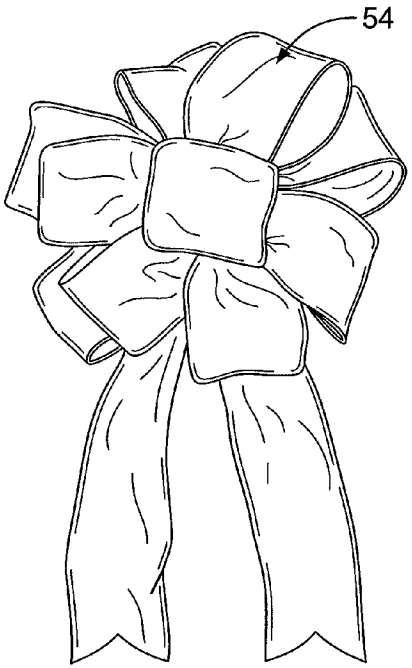

Referring to FIGS. 1 and 5A-E, further discussion shall now be had with respect to an exemplary embodiment of a method of bow making. Referring to FIGS. 1 and 5A, a user can dispense ribbon 54 through the slits 32 formed in a transparent portion 28 of the container 12. Referring to FIG. 5B, the user drops the wire 20 down through the channel 50 into the through 52 of the clip 16, and, above the wire, the user pulls down the ribbon 54 through the channel 50 into the receptacle 52, while taking care to further inhibit crimping. As shown in FIG. 5B, for example, the width of the ribbon is able to extend substantially across the receptacle 52, following along the parabolic surface 56, while significant crimping is inhibited. The ruler or indicia 40 can be used as a guide to measure out a segment of ribbon of length L. Referring to FIG. 5C, it is shown that the user then employs a folding motion to make "figure eights," where segments of ribbon are created with length L and dropped through the channel 50 into the receptacle 52 of the clip 16, while crimping is further inhibited. Referring to FIGS. 5D and 5E, it is shown that the flexible elongated member, e.g., wire 20, can be used to secure the folded ribbon segments 54 together. The secured-segments can be lifted through the channel 50, the wire 20 removed, and the bow provided.

It will be understood that the embodiments of the present invention described herein are merely exemplary and that a person skilled in the art may make many variations and modifications without departing from the spirit and the scope of the invention. All such variations and modifications, including those discussed above, are intended to be included within the scope of the invention as defined by the appended claims.

What is claimed is:

1. A bow making device, comprising:

a clip including a space through which a ribbon can be pulled;

at least one ribbon roll;

a container having a plurality of walls, an interior, and an opening adjacent said interior, said container being configured to receive said clip in said interior through said opening, said container configured to contain said at least one ribbon roll in said interior at least when said clip is received in said interior through said opening, at least one of said plurality of walls including transparent material having a slit for dispensing ribbon; and a lid for said container, said lid including a surface to which said clip is secured.

2. The bow making device of claim 1, wherein said clip includes (i) a first clip end, (ii) a channel extending from said first clip end, and (iii) a receptacle cooperating at least with said channel to form said space, said channel having a first width and said receptacle having a second width greater than said first width.

3. The bow making device of claim 2, wherein said receptacle includes a curved surface opening to face said channel.

4. The bow making device of claim 1, wherein said clip includes a base proximal said surface and a plurality of fingers extending from said base in a direction away from said surface, at least said base and said fingers cooperating to define said space.

5. The bow making device of claim 1, wherein said at least one ribbon roll comprises a first ribbon roll, and wherein said first ribbon roll is visually-perceptible through said transparent material.

6. The bow making device of claim 1, wherein said at least one ribbon roll comprises a first ribbon roll having ribbon of a first color and a second ribbon roll having ribbon of a second color different from said first color, and wherein said first ribbon roll and said second ribbon roll are visually-perceptible through said transparent material.

7. The bow making device of claim 1, including an elongated flexible member.

* * * * *